US005724051A

United States Patent [19]

Mailandt et al.

[11] Patent Number: 5,724,051

[45] Date of Patent: Mar. 3, 1998

[54] ANTENNA ASSEMBLY

[75] Inventors: Peter Mailandt, Dallas; Tan D. Huynh, Hurst, both of Tex.

[73] Assignee: Allen Telecom Inc., Solon, Ohio

[21] Appl. No.: 575,708

[22] Filed: Dec. 19, 1995

[51] Int. Cl.[6] ..... H01Q 9/28; H01Q 21/12

[52] U.S. Cl. ..... 343/795; 343/812

[58] Field of Search ..... 343/795, 810, 343/813, 812, 814, 815, 816, 817; H01Q 9/20, 21/10, 21/12

[56] References Cited

U.S. PATENT DOCUMENTS

| | | | |
|---|---|---|---|
| 2,573,914 | 11/1951 | Landon | 343/795 |
| 2,860,339 | 11/1958 | Kandohn | 343/795 |
| 2,978,703 | 4/1961 | Kuecken | 343/795 |
| 5,532,707 | 7/1996 | Klinger et al. | 343/795 |

OTHER PUBLICATIONS

Photographs of Antenna Model Type No. 734326, Manufactured by Kathrein–Werke KG, Rosenheim, Germany, 1710–1880 MHz.

*Primary Examiner*—Michael C. Wimer

*Attorney, Agent, or Firm*—Laff, Whitesel, Conte & Saret, Ltd.

[57] ABSTRACT

An antenna assembly having a base plate and at least one integrally formed antenna array mounted thereon, the antenna array having a pair of dipole antennas and an elongated transmission line, one of the dipole antennas being integrally formed with each end of the transmission line, with each dipole antenna comprising a pair of oppositely directed, elongated dipole arms, one of the arms being continuous in a direction transverse to its length in plan view and the other of the arms comprising a pair of spaced apart arm elements in a direction transverse to its length in plan view, and for each of the dipole antennas, mounting means integrally formed with each of the pair of dipole arms for securing the antenna array to the antenna assembly. A method of forming the antenna from a blank and by a series of folding steps is also disclosed.

17 Claims, 7 Drawing Sheets

FIG. 10
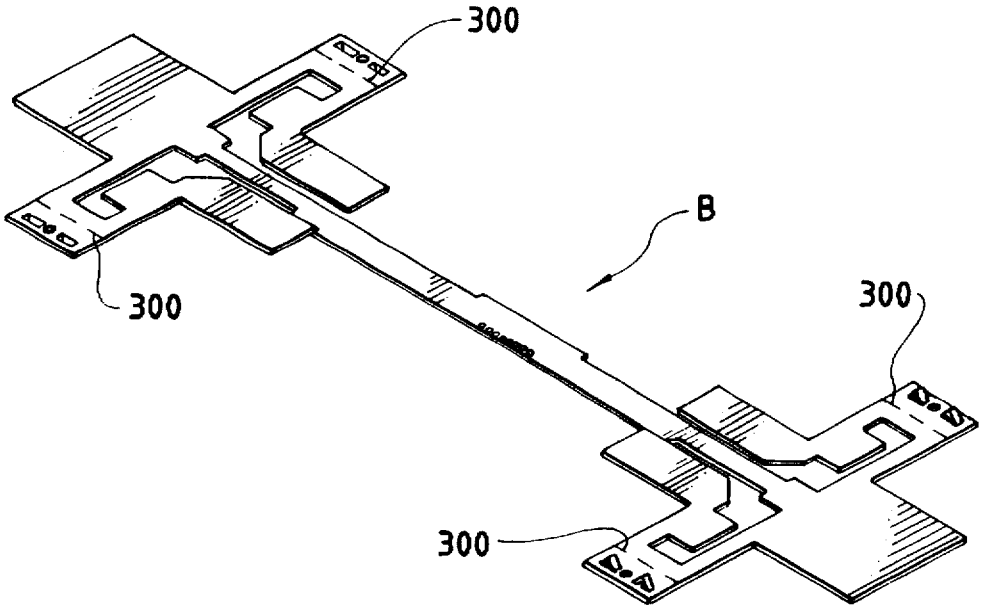
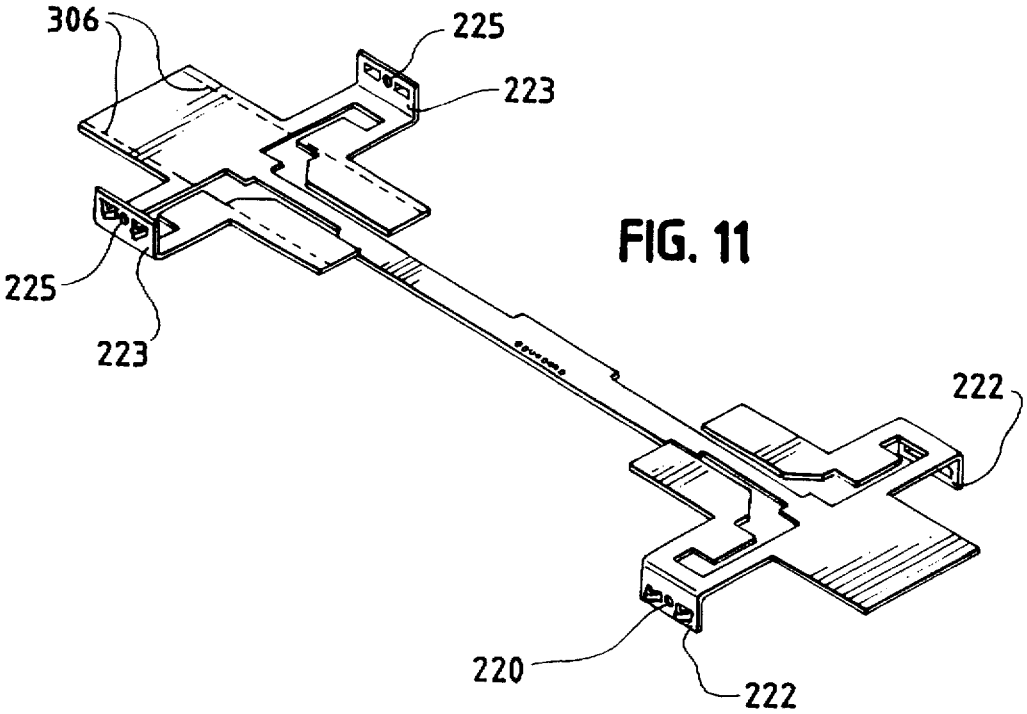
FIG. 11

ANTENNA ASSEMBLY

BACKGROUND OF THE INVENTION

Broadband base station antennas, such as for PCS use, are frequently designed to employ dipole antennas. Frequently, a plurality of these dipole antennas are utilized in such base station antennas, and typically the dipoles are fed through a power divider by a common transmission line. The more dipole antennas used in an antenna assembly, the more complex the power divider.

The manufacture of such base station antenna assemblies is time consuming and expensive, both in connection with the construction of the dipole antennas, and in their assembly with the remaining elements of the antenna assemblies. One recent attempt to simplify the construction and assembly of such antenna assemblies has been to form dipole antenna elements from a base member by punching them out from the base element and then forming the elements into a desired orientation. The dipole antennas are formed as opposed pairs to which a separately formed transmission line must be secured, as by soldering. Typically such base station antenna assemblies are made of a lightweight material, and the elements are therefore relatively fragile. The use of pairs of dipoles reduces power divider size and complexity. Of course, the formation process from a base member and separate members to be attached is an elaborate and expensive one.

It would be desirable to provide a broadband base station antenna employing an improved array of dipole antenna pairs and an improved method of making same.

SUMMARY OF THE INVENTION

In accordance with the present invention, a method of making an improved broadband base station antenna is provided. The method especially contemplates making an integrally formed pair of dipole antennas, each for radiating as an individual dipole antenna, the method comprising the steps of forming a flat precursor array from a sheet of conductive material, the precursor array comprising an elongated transmission line precursor having a pair of spaced ends, and a dipole antenna comprising a pair of dipole antenna arms at each end of the transmission line precursor, and folding the transmission line precursor relative to the dipole antenna arms at each end thereof to provide a finally formed transmission line which is integral with the dipole antennas.

In a preferred form, at each end of the transmission line precursor, the flat precursor array additionally comprises a pair of precursor support elements positioned adjacent to and integral with the dipole antenna arms, each of the precursor support elements having a free end, and the method comprises the further step of folding the support elements relative to the dipole antenna arms so that the free ends are adapted for securing said dipole antennas to a mounting structure. Desirably, the free ends of the support elements are folded to form mounting feet for facilitating securance of the dipole antennas to a mounting structure. The finally formed transmission line is preferably an air-substrated transmission line interconnecting each of the dipole antennas.

The present invention also provides an integrally formed antenna array comprising a pair of dipole antennas and an elongated transmission line, one of the dipole antennas being integrally formed with each end of the transmission line, each dipole antenna comprising a pair of oppositely directed, elongated dipole arms, one of the arms being continuous in a direction transverse to its length in plan view and the other of the arms comprising a pair of spaced apart arm elements in a direction transverse to its length in plan view, and for each of the dipole antennas, mounting means integrally formed with each of the pair of dipole arms for securing the antenna array to a mounting structure. The dipole arms preferably have a pair of opposite side edges and opposite free end edges, and the mounting means comprise elongated support elements formed with the pair of opposite side edges at one end of the support elements and mounting formations at the other ends of the elongated support elements. Desirably, the mounting formations comprise mounting feet formed integrally with the antenna array.

An antenna assembly in accordance with the present invention comprises a base plate and at least one integrally formed antenna array mounted thereon, the antenna array comprising a pair of dipole antennas, an elongated transmission line formed integrally at the ends thereof with the pair of dipole antennas, and mounting means integrally formed with the dipole antennas for mounting the antenna array to the base plate, each dipole antenna comprising a pair of oppositely directed, elongated dipole arms, one of the arms being continuous in plan view and the other comprising a pair of spaced apart arm elements in plan view. The transmission line ends are integrally formed with the continuous arm and lie between the spaced apart arm elements.

Desirably, the base plate is a conductive metal plate, and the assembly further comprises a cable element connected to the transmission line medial of its length. Preferably, via the conductor thereof for feeding the dipole antennas at least two of the antenna arrays are mounted on the base plate in a spaced apart relationship, and the transmission line defines a plurality of spaced formations for connecting the one conductor thereto to alter the radiation characteristics of the antenna assembly.

Further objects, features and advantages of the present invention will become apparent from the following description and drawings.

BRIEF DESCRIPTION OF THE DRAWINGS

FIG. 8(*a*) is a perspective view of a dipole pair array of FIG. 8 showing representative dimensions;

FIG. 10 is a perspective view of a blank from which the dipole pair array of FIGS. 8 and 9 may be formed;

FIG. 11 is a perspective view of the blank of FIG. 10 having portions thereof folded relative to other portions;

DETAILED DESCRIPTION

Figure 1:
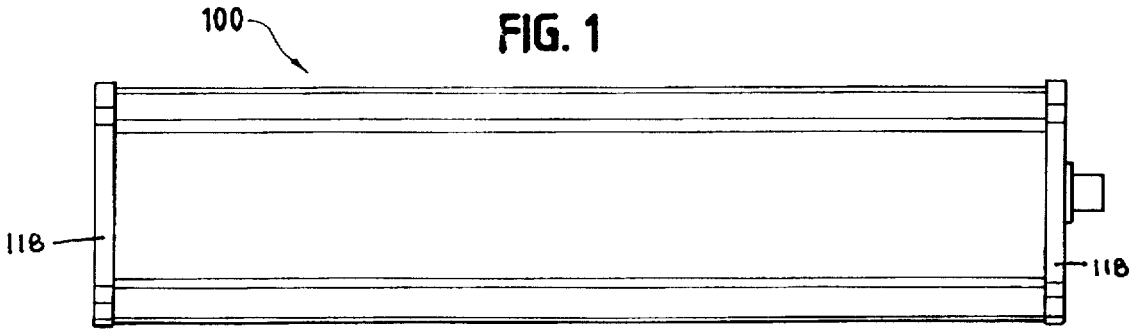
FIG. 1 is a plan view of an antenna assembly of the present invention.

Referring first to FIGS. 1–7, an antenna assembly 100 such as a broadband base station antenna assembly in accordance with the present invention includes a back plane or mounting plate 110. Mounting plate 110 is ordinarily designed to be conductive so as to provide a ground plane for the dipole antennas, and may be an aluminum extrusion having a series of longitudinally oriented central mounting tracks 112 and a pair of spaced longitudinal edge tracks 114 at its edges for securing an enclosure 116. Enclosure 116 is of a plastic material and may be generally U-shaped in cross-section. End caps 118 are of metal or plastic and are secured, as to the mounting plate 110, to provide ends for the assembly 100 and to complete the housing for the antenna assembly 100.

The antenna assembly 100 comprises a plurality of dipole antennas which are arrayed in pairs as will be described. In the embodiment illustrated in FIGS. 1–6, the dipole pair arrays 120 are two in number and are mounted on the plate 110 in a longitudinally spaced apart relationship. Either more or fewer arrays 120 may be similarly employed, such as one, three, four or five arrays, or even more if there is a suitable application for such.

Figure 2:
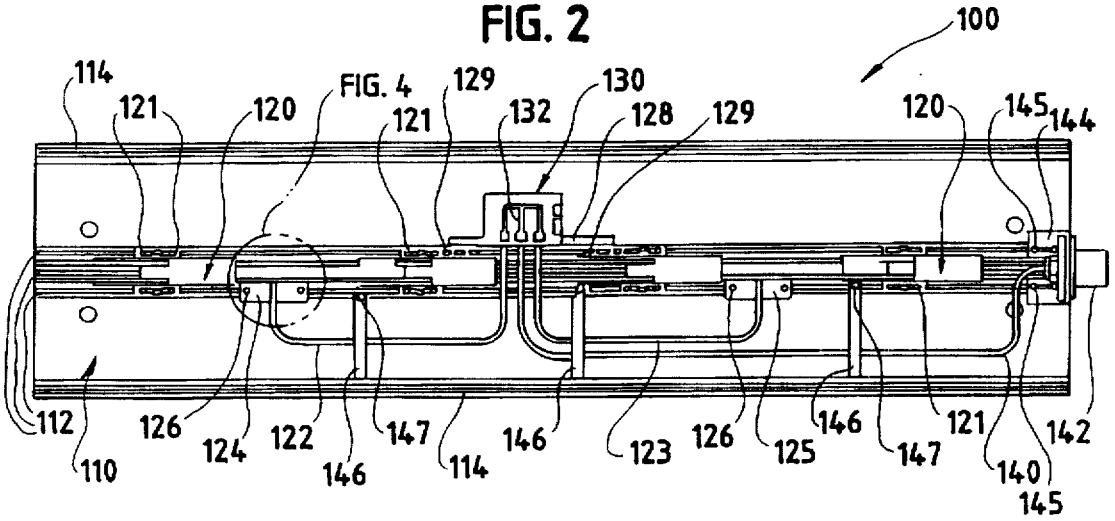
FIG. 2 is a plan view of the antenna assembly of FIG. 1 with the enclosure removed.
Figure 3:
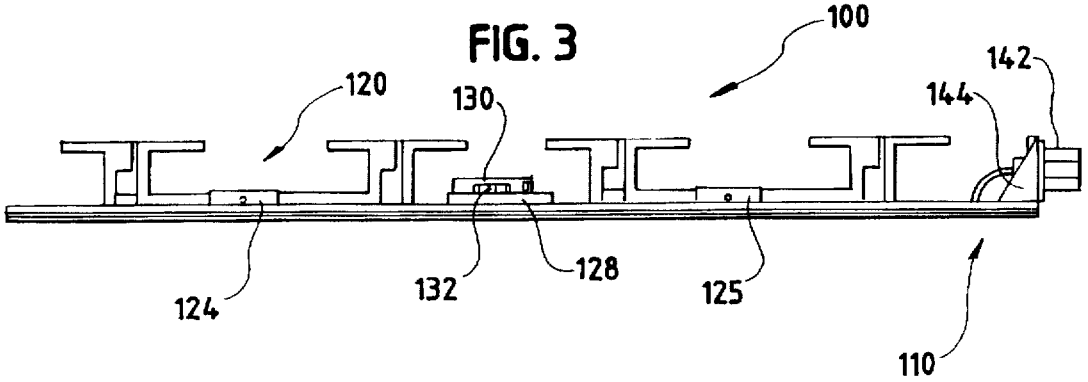
FIG. 3 is a side elevational view of FIG. 2.
Figure 4:
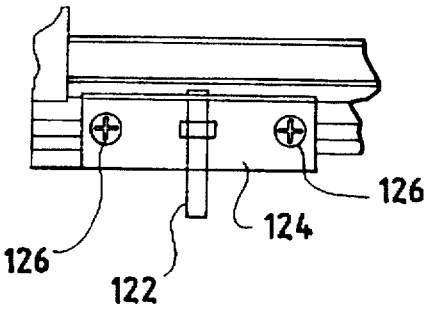
FIG. 4 is a fragmentary enlarged view of a portion of FIG. 2.
Figure 5:
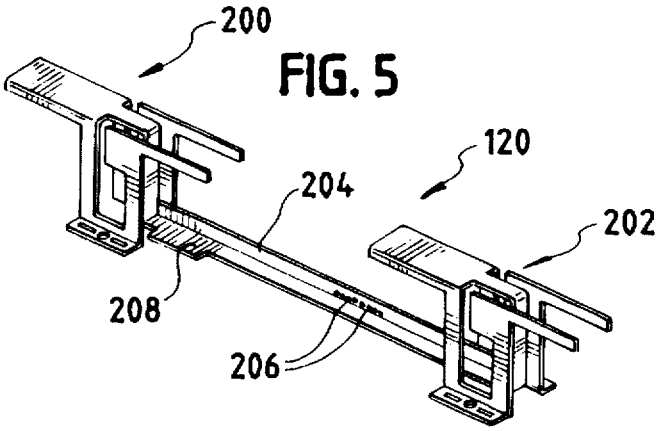
FIG. 5 is a perspective view of the dipole pair array of FIG. 2.
Figure 6:
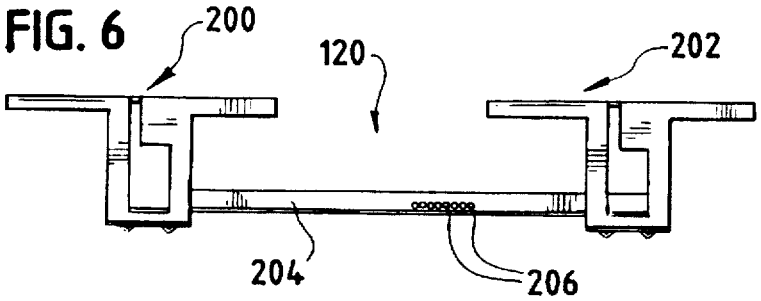
FIG. 6 is a side elevational view of the dipole pair array of FIG. 5.

As best seen in FIGS. 2 and 6, each dipole pair array 120 is integrally formed, as from a conductive blank stamped out from a thin brass sheet, and is secured to the tracks 112 by threaded fasteners, such as screws 121. Each array 120 is fed by the center conductor of an element cable 122, 123, respectively, which is grounded to the mounting plate 110 via a clip 124, 125, respectively, which is secured physically and electrically to a mounting plate track 112 via fasteners, such as screws 126. The shields of the respective element cables 122, 123 are brazed or soldered to the clips 124, 125. At their other ends, the shields of element cables 122, 123 are secured to a transformer clip 128 which is also connected physically and electrically to the mounting plate 110 via screws 129 and a mounting track 112, and the center conductors of the cables 122, 123 are connected, respectively, to a power divider or circuit board transformer 130, as by soldering or brazing. The transformer 130 may comprise a glass fiber board element, with a pair of generally U-shaped traces which merge to form an M-shaped trace pattern 132 of microstrip transmission lines. The transformer 130 acts to divide input power equally between the two dipole pair arrays 120, while maintaining a proper impedance match.

The center of the transformer trace pattern 132 is fed by the center conductor of a connector cable 140, whereas the transformer clip 128 is connected to the shield of the connector cable 140. The other end of the connector cable 140 is secured to a connector 142 to which a coaxial cable (not shown) leads. Thus, each of the dipole arrays 120 is connected to a source of RF (radio frequency) power via the connector 142 and transformer 130. Connector 142 may be mounted on a formed mounting clip 144 which is secured to the tracks 112 by screws 145 and which grounds the shield of the coaxial cable to the mounting plate 110. For stability, the connector cable 140 and element cables 122, 123 may be restrained intermediate their lengths by plastic clamps 146 which may be secured at one end under the lip of a track 114 and at the other end by a screw 147 secured to a track 112. The plastic clamps may be of a plastic such as Delrin®, an acetal homopolymer available from DuPont Company.

The antenna assembly 100 is designed to be mounted vertically, that is with the connector 142 facing downwardly and the back plane 110 substantially perpendicular to the earth's surface. The antenna assembly of FIGS. 1–7 is designed to radiate with a horizontal beamwidth pattern of 120 degrees. Thus, three such assemblies mounted at 120 degree spacing intervals around a mounting member would provide substantially circular coverage, if that were desired. The dipole arrays shown in FIGS. 8 to 16 are designed to provide a 90 degree horizontal beamwidth pattern, so that four antenna assemblies employing such dipole arrays, which assemblies are appropriately mounted relative to each other, can be used effectively substantially circular coverage where that is desired.

The dipole pair arrays 120 may be substantially identical to each other. To this end, each comprises a pair of dipoles 200, 202 (which may be substantially identical) and which are connected by an air-substrated transmission line 204. The transmission lines 204 are connected to the center conductors of the element cables 122, 123 adjacent feed clips 124, 125. The shields of the element cables are soldered or brazed to the clips 124, 125 which in turn are secured by screws 126 to the track 112. The center conductors are soldered at a selected one of a series of spaced formations, such as in openings 206 in the transmission line 204 medial of its length. The opening 206 selected will somewhat alter the angle of the vertical pattern of the antenna assembly 100, with respect to the earth's surface, as viewed in the normal operating orientation of the antenna assembly 100. When mounting openings 206 to the right of the left-most opening 206 (as seen in FIG. 6) are used, the lengths of the element cables 122, 123 should also be altered by increasing the length of element cable 123, or decreasing the length of element cable 122. The purpose of this is to maintain the proper phase relationship between the dipole pairs 120.

The transmission line 204 is also provided with a tuning tab 208, the size, shape and positioning of which is to maintain proper impedance matching irrespective of which of the mounting openings 206 is selected to receive the center conductor of the element cables 122, 123.

Typical dimensions of a dipole pair array 120 for use within a frequency range from about 1.71 to about 1.99 GHz (gigahertz) are shown in the Table below, and can best be understood in conjunction with FIGS. 7 and 8(*a*). The center-to-center distance between dipoles of the dipole pair should be approximately equal to one wavelength. For the frequency range of interest (about 1.71 to about 1.99 GHz), one wavelength is slightly more than six inches, although it has been found the a dimension "a" of 6.0 inches is nearly optimal for the antenna arrays in accordance with the invention. The dimension "b," corresponding to the length of each individual dipole, should ordinarily be about one-half wavelength, but, because of the unique geometries of the antennas, and because the dipole pairs of FIGS. 7 and 8(*a*) are designed for different horizontal beamwidths, the overall dipole length for the dipoles of FIG. 7 should be about 3.239 inches, and for FIG. 8(*a*) about 3.9 inches.

Figure 7:
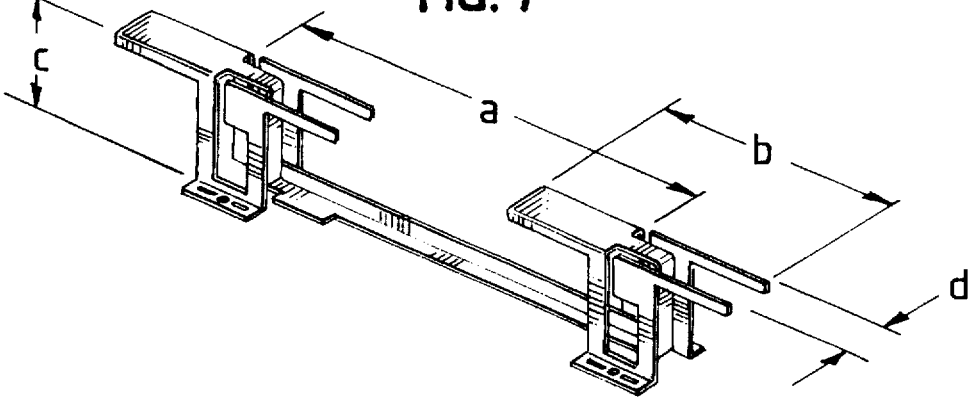
FIG. 7 is a perspective view of a dipole pair array of FIG. 5 showing representative dimensions.
Figure 8:
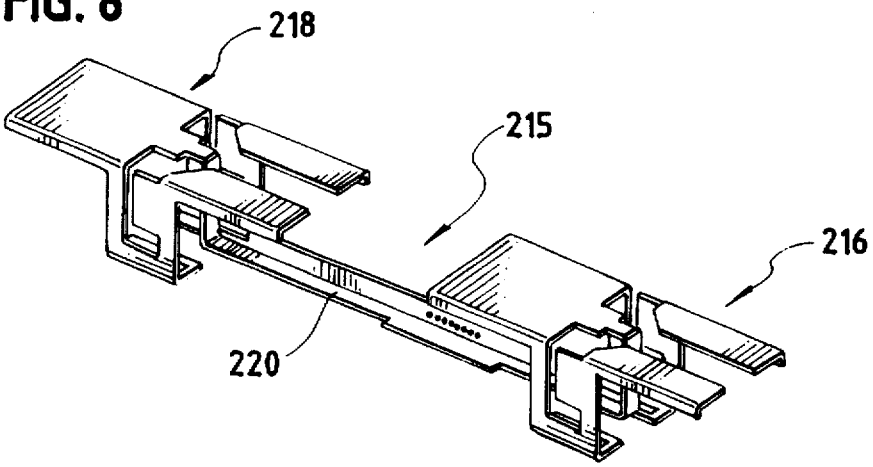
FIG. 8 is a perspective view of a further dipole pair array of the present invention.
Figure 8A:
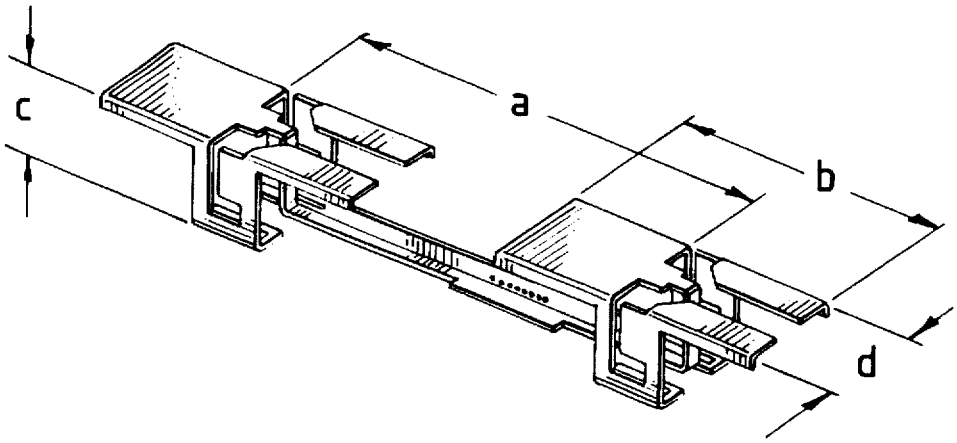

Since dipole width is tied directly to effective horizontal beamwidth, the dipoles of FIG. 7, designed for a 120 degree beamwidth, are about 0.664 inch wide, while the dipoles of FIG. 8(*a*), designed for a 90 degree beamwidth, are about 1.56 inches wide.

| | a | b | c | d |
|---|---|---|---|---|
| FIG. 7 | 6.0 | 3.239 | 1.6 | 0.664 |
| FIG. 8 (a) | 6.0 | 3.9 | 1.35 | 1.56 |

Theoretically, the dipoles should all be spaced about one-quarter wavelength above the back plane at the frequency of interest. However, if the spacing above the back plane is made too small, the Q (quality factor) of the antenna will go up dramatically, reducing the effective antenna bandwidth. Consequently, the dipoles of FIG. 7 are spaced about 1.6 inches above the back plane (dimension "c"), while the dipoles of FIG. 8(*a*) are spaced about 1.35 inches above the back plane.

An alternative, finally formed dipole pair array 215 is illustrated in FIGS. 8, 8(*a*) and 9. It is integral and is formed from a blank B. As seen in FIG. 10, a flat, precursor array or blank B is punched or stamped out of a suitable material, such as out of a brass sheet about 0.032 inch thick. The blank B provides a precursor transmission line for the transmission line 220 and, at each spaced end thereof, provides precursor dipole arms for each of the pair of dipoles 216, 218.

Figure 12:
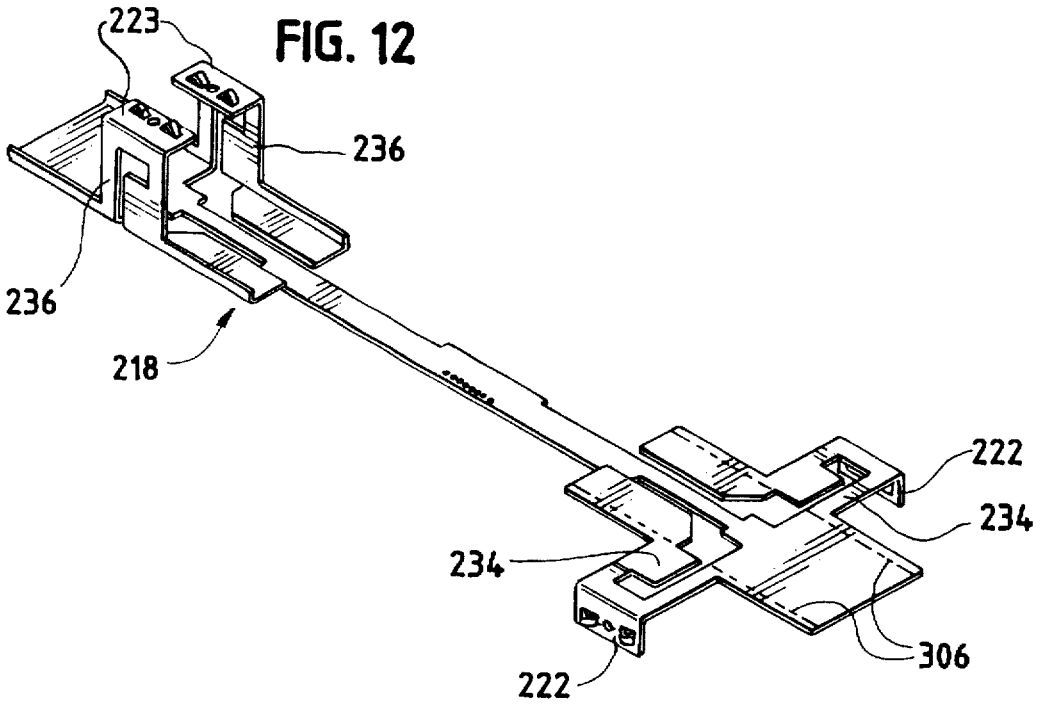
FIG. 12 is a perspective view after further forming of the precursor of FIG. 11.
Figure 13:
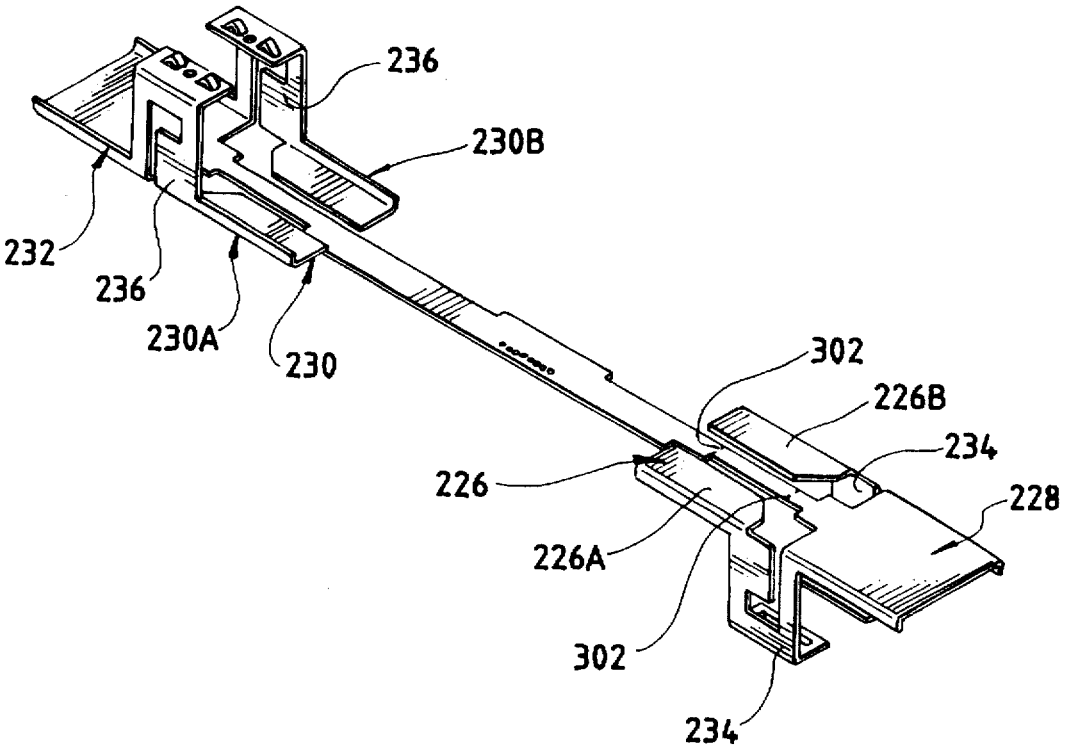
FIG. 13 is a perspective view after further forming of the precursor of FIG. 12.

As seen in FIGS. 10 and 11, mounting feet 222, 223, respectively, having suitable openings 224, 225, respectively, for mounting screws are formed along fold lines 300 for each of the dipole arrays. As shown by FIGS. 12 and 13, the dipole arms 226, 228 and 230, 232, and the pairs of support elements or supports 234 and 236 (with which feet 222, 223 are respectively integrally formed) are next formed into their final shapes and array by folding along the fold lines 306 shown in FIGS. 11 and 12, respectively. The support elements are positioned adjacent to and are formed integrally with the dipole antenna arms. Each support has a free end adapted, via the feet, to secure the dipole antennas to the mounting base. The other ends are formed with and folded relative to the antenna arms. The oppositely directed dipole arms 226 and 228 are shaped differently from each other in plan view, but function similarly within the design parameters of the antenna assembly. Similarly, the dipole arms 230 and 232 are differently shaped in plan view but function similarly. Thus, that dipole arms 226 and 230 each comprise a pair of closely spaced adjacent arm members 226A and 226B and 230A and 230B, respectively, rather than being solid or continuous across their widths (in a direction transverse to their lengths), as are arms 228 and 232, does not affect the radiation at the frequency of operation for which the illustrated antenna is designed, namely in the 1.71 to 1.99 GHz range.

Figure 14:
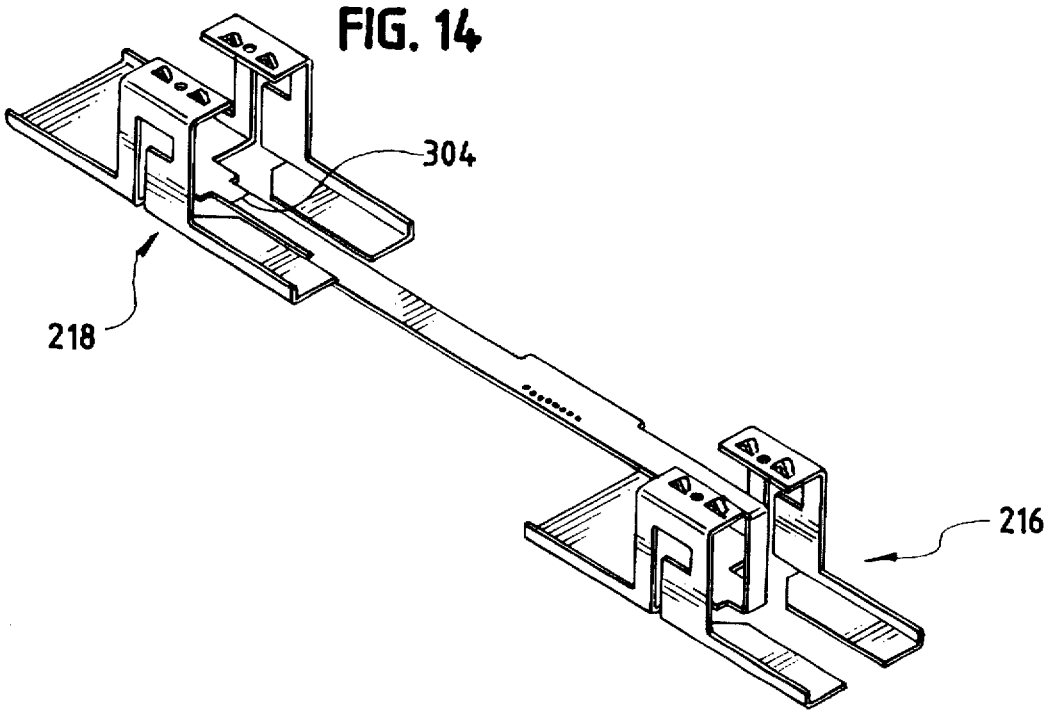
FIG. 14 is a perspective view after further forming of the precursor of FIG. 13.
Figure 15:
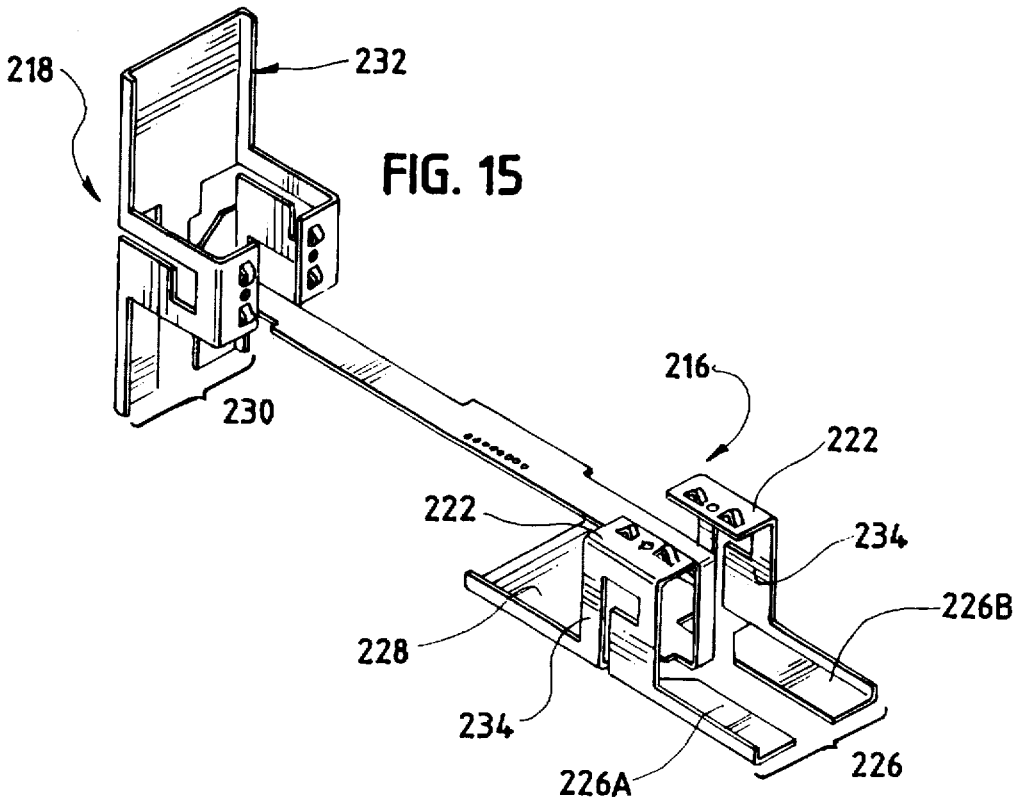
FIG. 15 is a perspective view after further forming of the precursor of FIG. 14.
Figure 16:
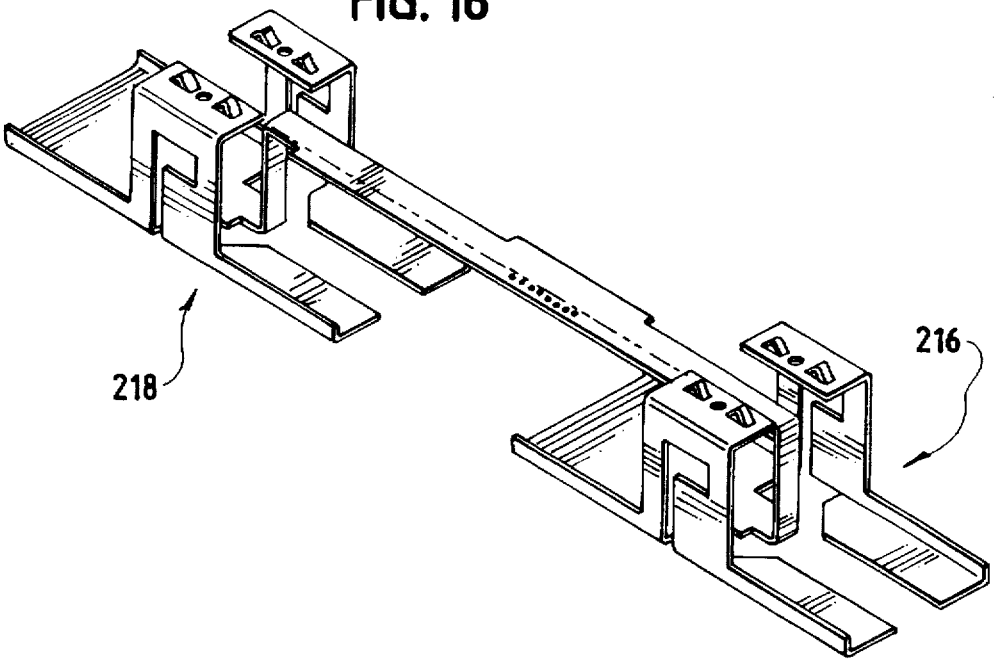
FIG. 16 is a perspective view after forming of the precursor of FIG. 15 and ready for a final forming operation.

To facilitate bending of the precursor transmission line element, as shown in FIG. 13, the transmission line precursor is punched to reduce its thickness in zones 302, and the assembly is then bent and folded to the configurations shown in FIG. 14. The transmission line precursor is then similarly punched at 304 (FIG. 14), and is bent and folded from the position shown in FIG. 14 to the positions of FIGS. 15 and 16, thereby assuming the final dipole pair array configuration of FIGS. 8 and 9 and providing the finally formed, integral, air-substrated transmission line.

Figure 9:
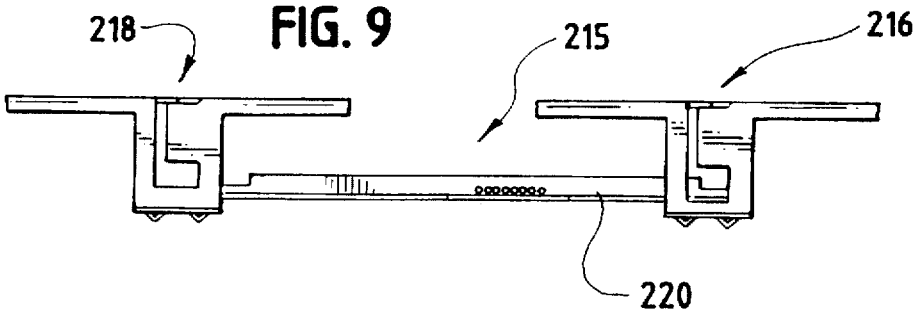
FIG. 9 is a side elevational view of the dipole pair array of FIG. 8.

The dipole pair array is then ready to be secured in an antenna assembly like that of FIGS. 1–7, but employing the dipole arrays of FIGS. 8 and 9. To that end, the dipole pair array 215 is adapted to be secured via screws to a mounting plate 110 via tracks 112, as in the manner described with respect to the embodiment of FIGS. 1–7. The arrays are similarly provided with element cables, a connector cable, a transformer and the other elements described in connection with FIGS. 1–7.

From the foregoing, it will be apparent that an antenna assembly employing a plurality of dipole antennas may be easily constructed from a minimum number of elements, while combining pairs of dipoles into subassemblies which are easily fabricated and over which close control of dimensions and relationships of the parts may be maintained.

Although but several embodiments have been illustrated, it will be apparent that modifications may be made without departing from the spirit and scope of the invention. Accordingly, the invention is not to be considered as being limited to the illustrated embodiments or as being otherwise limited except as may be made necessary by the appended claims.

What is claimed is:

1. A method of making an integrally formed pair of dipole antennas, each for radiating as an individual dipole antenna, comprising the steps of:

forming a flat precursor array from a sheet of conductive material, said precursor array comprising an elongated transmission line precursor having a pair of spaced ends, and a pair of dipole antennas, one of said pair of dipole antennas being located at each end of the transmission line precursor, each said dipole antenna comprising a pair of dipole antenna arms, and folding said transmission line precursor relative to said dipole antennas at each end thereof to provide a finally formed transmission line which is integral with each of said dipole antennas.

2. The method in accordance with claim 1, and wherein at each end of said transmission line precursor said flat precursor array additionally comprises a pair of precursor support elements positioned adjacent to and integral with the dipole antenna arms, each of said precursor support elements having a free end, and comprising the further step of folding said support elements relative to said dipole antenna arms so that said free ends are adapted for securing said dipole antennas to a mounting structure.

3. The method of claim 2, and comprising the further step of folding the free ends of the support elements to form mounting feet for facilitating securance of said dipole antennas to a mounting structure.

4. The method of claim 1, wherein said finally formed transmission line is an air-substrated transmission line interconnecting each of said dipole antennas.

5. A method of making an integrally formed pair of dipole antennas, each for radiating as an individual dipole antenna, comprising the steps of:

forming a flat precursor array from a sheet of conductive material, said precursor array comprising an elongated transmission line precursor having a pair of spaced ends, a pair of dipole antennas, one of said pair of dipole antennas being located at each end of the transmission line precursor, each said dipole antenna comprising a pair of dipole antenna arms, and a pair of precursor support elements positioned adjacent to and integral with the dipole antenna arms, each of said precursor support elements having a free end, folding said transmission line precursor relative to said dipole antennas at each end thereof to provide a finally formed transmission line which is integral with each of said dipole antennas, and folding said support elements relative to said dipole antenna arms so that said free ends are adapted for securing said dipole antennas to a mounting structure.

6. The method of claim 5, wherein said finally formed transmission line is an air-substrated transmission line interconnecting each of said dipole antennas.

7. An integrally formed antenna array comprising a pair of dipole antennas and an elongated transmission line, one of said dipole antennas being integrally formed with each end of said transmission line, each said dipole antenna comprising a pair of oppositely directed, elongated dipole arms, one of said arms being continuous in a direction transverse to its length in plan view and the other of said arms comprising a pair of spaced apart arm elements in a direction transverse to its length in plan view, and for each of said dipole antennas, mounting means integrally formed with each of said pair of dipole arms for securing said antenna array to a mounting structure.

8. The integrally formed antenna array of claim 7, and wherein said dipole arms have a pair of opposite side edges and opposite free end edges, and wherein said mounting means comprises elongated support elements formed with said pair of opposite side edges at one end of said support elements and mounting formations at the other ends of said elongated support elements.

9. The integrally formed antenna array of claim 7, and wherein said mounting means comprise mounting feet formed integrally with said antenna array.

10. An antenna assembly comprising a base plate and at least one integrally formed antenna array mounted thereon, said antenna array comprising a pair of dipole antennas, an elongated transmission line formed integrally at the ends thereof with said pair of dipole antennas, and mounting means integrally formed with said dipole antennas for mounting said antenna array to said base plate, each said dipole antenna comprising a pair of oppositely directed, elongated dipole arms, one of said arms being continuous in plan view and the other comprising a pair of spaced apart arm elements in plan view.

11. The antenna assembly of claim 10, and wherein said transmission line ends are integrally formed with said continuous arm and lie between said spaced apart arm elements.

12. The antenna assembly of claim 10, and wherein said base plate is a conductive metal plate, and further comprising a cable element connected to said transmission line medial of its length via one conductor thereof for feeding said dipole antennas.

13. The antenna assembly of claim 10, and wherein at least two of said antenna arrays are mounted on said base plate in a spaced apart relationship.

14. The antenna assembly of claim 12, and wherein said transmission line further includes means for altering the radiation characteristics of said antenna assembly.

15. The antenna assembly of claim 14, wherein said means for altering the radiation characteristics of said antenna assembly comprises means for altering the vertical radiation pattern of the antenna assembly.

16. The antenna assembly of claim 15, wherein said means for altering said vertical radiation pattern of said antenna assembly comprises means for altering the angle of said vertical radiation pattern with respect to the earth's surface.

17. The antenna assembly of claim 15, wherein said means for altering said vertical radiation pattern of said antenna assembly comprises a plurality of spaced formations along said transmission line for connecting said one conductor thereto.

* * * * *